US005078811A

United States Patent [19]

Ames et al.

[11] Patent Number: 5,078,811

[45] Date of Patent: * Jan. 7, 1992

[54] METHOD FOR MAGNETIC DOMAIN REFINING OF ORIENTED SILICON STEEL

[75] Inventors: S. Leslie Ames, Sarver; Charles D. Boyer, Natrona Heights, both of Pa.

[73] Assignee: Allegheny Ludlum Corporation, Pittsburgh, Pa.

[ * ] Notice: The portion of the term of this patent subsequent to Mar. 27, 2007 has been disclaimed.

[21] Appl. No.: 414,962

[22] Filed: Sep. 29, 1989

[51] Int. Cl.[5] ..... H01F 1/04

[52] U.S. Cl. ..... 148/113

[58] Field of Search ..... 148/110, 111, 112, 113

[56] References Cited

U.S. PATENT DOCUMENTS

| | | | |
|---|---|---|---|
| 3,647,575 | 3/1972 | Fiedler et al. | 148/111 |
| 3,990,923 | 11/1976 | Takashina et al. | 148/111 |
| 4,513,597 | 4/1985 | Kimoto et al. | 72/53 |
| 4,680,062 | 7/1987 | Shen et al. | 148/111 |
| 4,911,766 | 3/1990 | Ames et al. | 148/113 |
| 4,968,361 | 11/1990 | Ames et al. | 148/110 |

FOREIGN PATENT DOCUMENTS

| | | |
|---|---|---|
| 61-133321 | 6/1986 | Japan . |
| 61-139679 | 6/1986 | Japan . |
| 61-284529 | 12/1986 | Japan . |
| 2167324A | 5/1986 | United Kingdom . |

*Primary Examiner*—John P. Sheehan
*Attorney, Agent, or Firm*—Patrick J. Viccaro

[57] ABSTRACT

A method is provided to effect domain refinement of grain-oriented silicon steel sheets having a surface layer of forsterite by applying to the layer a phosphorus-rich flux-printing agent having a desired composition, and degree of fluidity in a sufficient amount to effect removal of the forsterite layer in a striped pattern with sufficient phosphorus to subsequently chemically stripe the underlying metal with phosphide-bearing bodies to produce in the steel a heat-proof domain refinement with improved lower core loss values, after first heating in an oxidizing atmosphere and second heating in a reducing atomsphere.

17 Claims, 3 Drawing Sheets

2000 X

30 X

200 X

2000 X

1000 X

METHOD FOR MAGNETIC DOMAIN REFINING OF ORIENTED SILICON STEEL

BACKGROUND OF THE INVENTION

This invention relates to the production of grain-oriented silicon steel having very low core losses by a procedure employing simultaneous phosphorus flux-printing through the forsterite layer and phosphorus contamination of the exposed lines of substrate metal. The surface condition so developed permits a subsequent annealing treatment to develop heat-proof domain refinement of the steel.

DESCRIPTION OF THE PRIOR ART

There has been a long history in the steel industry of the production of steel containing 2.0 to 4.5% of silicon for electrical purposes. The premium grades are of the so-called grain-oriented variety. Grain-oriented silicon steel is conventionally used in electrical applications, such as power transformers, generators, and the like. The steel's ability to permit cyclic reversals of the applied magnetic field with only limited energy loss is a most important property. Reductions of this loss, which is termed "core loss", is desirable.

In the manufacture of grain-oriented silicon steel, it is known that the Goss secondary recrystallization texture, (110) [001] in terms of Miller's indices, results in improved magnetic properties, particularly permeability and core loss over nonoriented silicon steels. The Goss texture refers to the body-centered cubic lattice comprising the grain or crystal being oriented in the cube-on-edge position. The texture or grain orientation of this type has a cube edge paralleled to the rolling direction and in the plane of rolling, with the (110) plane being in the sheet plane. As is well known, steels having this orientation are characterized by a relatively high permeability in a direction at right angles thereto.

In the manufacture of grain-oriented silicon steel, typical steps include providing a melt having the order of 2–4.5% silicon, casting the melt, hot rolling to sheet, cold rolling the steel to final gauge typically of 7 or 9 mils, and up to 14 mils with an intermediate annealing when two or more cold rollings are used, decarburizing the steel, applying a refractory oxide base coating, such as a magnesium oxide coating, to the steel, and final texture annealing the steel at elevated temperatures in order to produce the desired secondary recrystallization and purification treatment to remove impurities such as nitrogen and sulfur. The development of the cube-on-edge orientation is dependent upon the mechanism of secondary recrystallization wherein during recrystallization, secondary cube-on-edge oriented grains are preferentially grown at the expense of primary grains having a different and undesirable orientation.

The final texture annealed grain-oriented silicon steel sheet has an insulation coating thereon resulting from an annealing separator coating, i.e., refractory oxide base coating, applied before the texture anneal to stop the laps of the coil from thermally welding or sticking together during the high temperature anneal and to promote formation of an oxide film on the steel surface. This film is desirable because it is an electrical insulator and can form part, or sometimes all, of the insulation needed when the steel is in operation in a transformer. Such an insulative oxide coating forming naturally during the texture anneal is known variously as forsterite, the base coating, or mill glass.

As used herein, "sheet" and "strip" are used interchangeably and mean the same unless otherwise specified.

It is also known through the efforts of many prior art workers, that cube-on-edge grain-oriented silicon steels generally fall into basic categories: first, regular or conventional grain-oriented silicon steel, and second, high permeability grain-oriented silicon steel. Permeability at 10 Oersteds is frequently used as an indicator of the degree of perfection of the grain orientation; complete perfection of the orientation would yield a permeability of about 2000. Regular grain-oriented silicon steel is generally characterized by permeability of less than 1850 at 10 Oersteds with a core loss of greater than 0.400 watts per pound (WPP) at 1.5 Tesla at 60 Hertz for nominally 9-mil material. High permeability grain-oriented silicon steels are characterized by permeabilities of about 1850–1950. Such higher permeabilities may be the result of compositional changes alone or together with process changes. For example, high permeability silicon steels may contain nitrides, sulfides, and/or borides which contribute to the precipitates and inclusions of the grain-growth inhibition system which contributes to the properties of the final steel product. High permeability silicon steels generally undergo heavier cold rolling reduction to final gauge than regular grain-oriented steels with final heavy cold reduction on the order of greater than 80%. While higher permeability materials are desirable because of their potential for lower core loss, such materials tend to produce larger magnetic domains than conventional material. Larger domains are deleterious to core loss and tend to offset the benefit to core loss of the improved permeability. Larger domains are also favored by lighter gauge. In other words, if one compares a 7-mil and a 9-mil material at identical permeability, the 7-mil sample would have larger domain size.

It is known that one of the ways that domain size and thereby core loss values of electrical steels may be reduced is if the steel is subjected to any of various practices designed to induce localized strains in the surface of the steel. Such practices may be generally referred to as "domain refining by scribing" and are performed after the final high temperature annealing operation. If the steel is scribed after the final texture annealing, then there is induced a localized stress state in the texture-annealed sheet so that the domain wall spacing is reduced. These disturbances typically are relatively narrow, straight lines, or scribes, generally spaced at regular intervals. The scribe lines are substantially transverse to the rolling direction and typically are applied to only one side of the steel. The scribing imposes mechanical damage to the steel either directly by some form of surface scratching, cutting, abrading, or, indirectly, by thermal shock treatment such as by a laser. See U.S. Pat. Nos. 3,647,575, issued Mar. 7, 1972; 4,513,597, issued Apr. 30, 1985; and 4,680,062, issued July 14, 1987.

In fabricating electrical steels into transformers, the steel inevitably suffers some deterioration in core loss quality due to cutting, bending, and construction of cores during fabrication, all of which impart undesirable stresses in the material. During fabrication incident to the production of stacked core transformers and, more particularly, in the power transformers of the United States, the deterioration in core loss quality due to fabrication is not so severe that a stress relief anneal (SRA), typically about 1475° F (801° C), is essential to restore usable properties. For such end uses there is a need for a flat, domain-refined silicon steel which need not be subjected to stress relief annealing. In other words, the scribed steel used for this purpose does not have to possess domain refinement which is heat resistant.

However, during the fabrication incident to the production of most distribution transformers in the United States, the steel strip is cut and subjected to various bending and shaping operations which produce more worked stresses in the steel than in the case of power transformers. In such instances, it is necessary and conventional for manufacturers to stress relief anneal (SRA) the product to relieve such stresses. During stress relief annealing, it has been found that the beneficial effect on core loss resulting from some scribing techniques, such as mechanical and thermal scribing, are lost. For such end uses, it is required and desired that the product exhibit heat resistant domain refinement (HRDR) in order to retain the improvements in the core loss values.

It is known in the art of making electrical steel to attempt to produce heat resistant domain refinement. It has been suggested in prior patent art that contaminants or intruders may be effective in refining the magnetic domain wall spacing of grain-oriented silicon steel. U.S. Pat. No. 3,990,923 - Takashina et al, dated Nov. 9, 1976, discloses that chemical treatment may be used on primary recrystallized silicon steel (i.e., before final texture annealing) to control or inhibit the growth of secondary recrystallization grains. British Patent Application 2,167,324A discloses a method of subdividing magnetic domains of grain-oriented silicon steels to survive a SRA. The method includes imparting a strain to the sheet, forming an intruder on the grain-oriented sheet, the intruder being of a different component or structure than the electrical sheet and doing so either prior to or after straining and thereafter annealing such as in a hydrogen reducing atmosphere to result in imparting the intruders into the steel body. Numerous metals and nonmetals are identified as suitable intruder materials.

Japanese Patent Document 61-133321A discloses removing surface coatings from final texture annealed magnetic steel sheet, forming permeable material coating on the sheet and heat treating to form material having components or structure different than those of the steel matrix at intervals which provide heat resistant domain refinement.

Japanese Patent Document 61-139-679A discloses a process of coating final texture annealed oriented magnetic steel sheet in the form of linear or spot shapes at intervals with at least one compound selected from the group of phosphoric acide, phosphates, boric acid, borates, sulfates, nitrates, and silicates, and thereafter baking at 300–1200° C., and forming a penetrated body different from that of the steel to refine the magnetic domains.

Japanese Patent Document 61-284529A discloses a method of removing the surface coatings from final texture annealed magnetic steel sheets at intervals, coating one or more of zinc, zinc alloys, and zincated alloy at specific coating weights, coating with one or more of metals having a lower vapor pressure than zinc, forming impregnated bodies different from the steel in composition or in structure at intervals by heat treatment or insulating film coating treatment to refine the magnetic domains.

In accordance with the teaching of a copending U.S. patent application, Ser. No. 206,152, filed June 10, 1988, now U.S. Pat. No. 4,911,766, filed by the common Assignee of this application, it is known to effect a heat resistant domain refinement of grain-oriented silicon steel by using an intrusion of phosphorus subsequent to some form of scribing technique. In a second copending U.S. patent application, Serial No. 327,946, filed March 23, 1989, now U.S. Pat. No. 4,968,361, by said common Assignee, it is known to use a flux printing agent made up of a group including phosphoric acid to effect the "striping" pattern in the forsterite base coating. Both of these copending applications disclose methods which, although relatively simple and effective, require a final diffusion anneal of sufficient duration, e.g., greater than 1 hour, that mandates a batch-type process. What is needed is an improvement in these methods in which all treatments are of short duration (e.g., less than about 15 minutes) so that the whole process is amenable to a continuous (strand) processing approach for potential commercial scale-up. Strand operations are widely used in the metallurgical industry because they are usually considerably less costly than their batch counterparts.

SUMMARY OF THE INVENTION

It is the object of the present invention to provide a rapid method of obtaining a heat resistant domain refinement of grain-oriented silicon steel having very low core losses by simultaneous phosphorus fluxprinting through the forsterite layer and charging the exposed lines of substrate metal with phosphorus. A subsequent heat treatment completes the development of domain-refined structure and lowered core loss.

According to the present invention the method includes effecting a striping of a predetermined pattern of parallel stripes in the forsterite layer formed in the outer surface of the steel, the pattern being formed by a combined printing of a fluxing and chemical striping agent made up in major part of phosphorus and phosphorus-bearing compounds to assure simultaneous effective flux printing and chemical striping.

DETAILED DESCRIPTION OF THE PREFERRED EMBODIMENTS

The present invention contemplates employing, in one and the same application, phosphorus as both a fluxing striping agent and as a chemical striping element to effect heat resistant domain-refinement to effect both results from one operation. It includes using a fluxing agent rich in phosphorus and using it in sufficient amount to not only dissolve the forsterite glass, but to charge enough residual phosphorus into the attacked region to provide magnetic domain refining. The invention includes employing an oxidizing atmosphere, such as air, firing of the printed flux, producing phosphate reaction products, followed by heating in a reducing atmosphere, such as hydrogen, to reduce the phosphates to phosphides. With restricted access to the underlying steel, e.g., only through the flux-produced craters in the base glass, iron phosphides will be produced with the wedge-shaped morphology associated with good domain refining.

In general terms in accordance with the teachings of the present invention, the method includes applying, preferably by printing, a phosphorus-rich flux agent to the base coated steel in a desired pattern. It has been found that conventional printing techniques and equipment may be suitable if modified so as to apply a suitable agent to the silicon steel at desired speeds, thicknesses and patterns.

The flux-printing agent of the present invention includes a major component selected from the group of phosphorus and phosphorus-bearing compounds. What is important is that the agent is rich in phosphorus in order that subsequent processing will cause the phosphorus to react to effect domain refinement.

Various printing techniques may be suitable for the present invention including stencil, offset, intagliotype, planographic, lithographic, and flexographic. Two methods and equipment of continuous printing are shown schematically in FIGS. 1 and 2.

Figure 1:
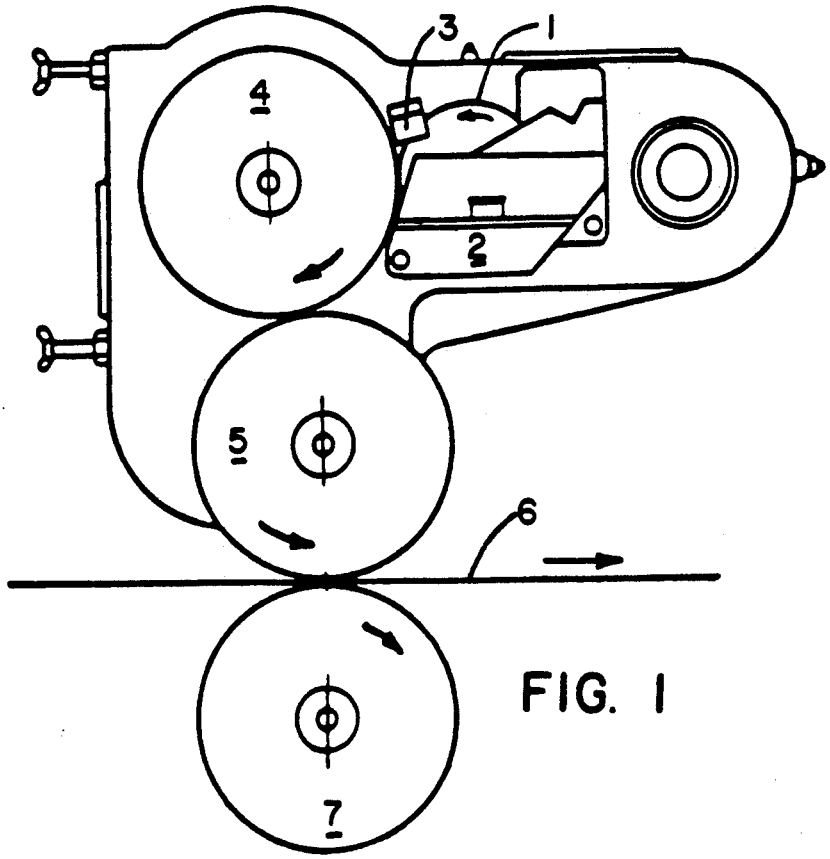
FIG. 1 is a schematic of an offset printing press.

FIG. 1 is a schematic of a widely-used conventional offset printing press in which a cluster of three rolls is used in applying the ink. The ink roll 1 rotates about its axis, dips into ink well 2, collects a layer of ink which is metered or wiped to a uniform layer as it passes against metering bar 3. The inked roll 1 then presses against the rotating second roll, i.e., print roll 4 on which the print, pattern, or design (hereinafter print-message) is located. The inked print roll 4 then presses against rotating third roll 5, the so-called blanket roll, on to which the print-message is transferred from roll 4. Finally, the rotating blanket message is transferred to the strip 6 as it moves continuously between roll 5 and backup roll 7. The backup roll 7 may or may not be necessary with this invention although it is conventionally used in the paper industry.

Figure 2:
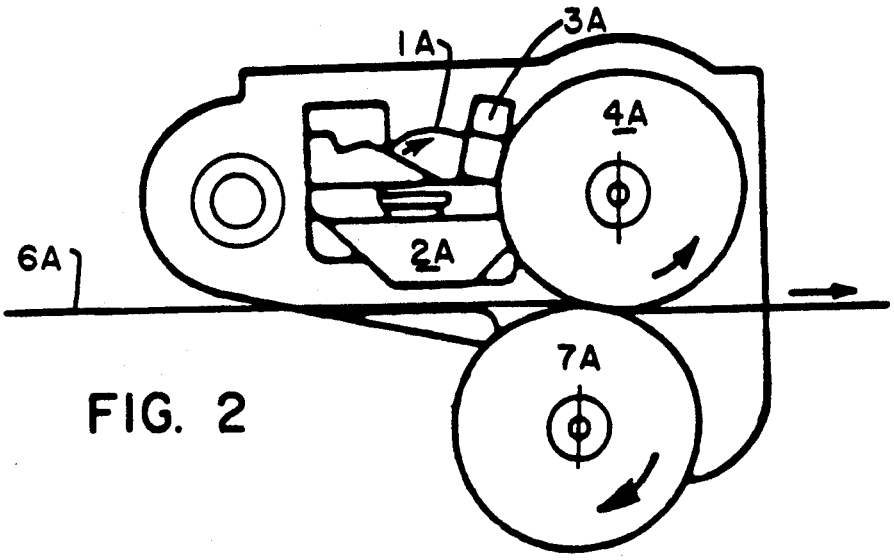
FIG. 2 is a schematic of a flexographic printing press.

In FIG. 2, a schematic of known flexographic printing is illustrated. The process is a modification of conventional three-roll offset printing, with the important difference being that new materials which are both tough and flexible are used for the print roll 4A. Such new materials may be special rubbers or photo-polymers. They are sufficiently rugged for making direct contact with and printing on the moving substrate rather than via a blanket roll. Although the ink delivery roll 1 for offset printing of FIG. 1 is conventionally solid and smooth, the flexographic printer of FIG. 2 has a honeycombed surface of ink roll 1A against which the flexible print roll 4A presses, literally sucking the ink out of the honeycomb cells., the ink-delivery roll is called the anilox roll in the technology of flexographic printing. As with offset printing, the backup roll 7A included in FIG. 2 is conventional but may not be essential for strong substrates such as metal.

The consistency and viscosity of the ink used in printing techniques may vary and is dependent on the technique used. For example, the ink used for offset printing has to be of similar viscosity to thick syrup (e.g., 10,000 centipoise). Flexographic printing is much more tolerant of ink viscosity and is capable of printing inks from this liquid to paste consitencies.

Grain-oriented silicon steel used in the herein disclosed tests was produced by casting, hot rolling, normalizing, cold rolling to intermediate gauge, annealing and cold rolling to final gauge, decarburizing, and final texture annealing to achieve the desired secondary recrystallization of cube-one-edge orientation. Typical melts of nominal initial composition of conventional (Steel 1) and high permeability (Steel 2) grain-oriented silicon steels were:

| | C | N | Mn | S | Si | Cu | B | Fe |
|---|---|---|---|---|---|---|---|---|
| Steel 1 | 030 | <50 ppm | .07 | .022 | 3.15 | .22 | — | Bal. |
| Steel 2 | 030 | <50 ppm | .038 | .017 | 3.15 | .30 | 10 ppm | Bal. |

After final texture annealing, the C, N, and S were reduced to trace levels of less than about 0.001%. The strip was cut into numerous pieces to produce samples of sizes sufficient for processing in accordance with the present invention. Final sample size for magnetic testing was that of the well known Epstein strip of 30 cm. long×3 cm. wide. Epstein strips were tested both as stacked packs and as single strips as indicated.

The method of the present invention recognizes that the layer of forsterite required to be broken through or substantially dissolved by the flux is very thin, typically 5 microns (0.005 mm). As is described in the above-mentioned U.S. Pat. No. 4,968,361 the layer can be penetrated easily and quickly, using a small amount of a fluxing agent. It was also found that phosphorus is an effective fluxing agent. The flux agent is applied to the forsterite surface in the precise pattern of lines needed for subsequent chemical and/or thermal treatment to develop heat-proof domain refinement.

As used herein, the pattern of exposed or substantially exposed pattern of lines through the forsterite to the silicon steel substrate is referred to as "metal stripes." The introduction of phosphorus from the flux in excess of that necessary to merely break through or dissolve the forsterite is known as "charging" the sample (with phosphorus). Subsequent reduction of the phosphate, to the required phosphide, is referred to as "curing." As will be evident from the examples, the phosphates do not lead to domain refinement while the phosphides (produced by curing) do.

After applying the flux-printing agent to the coated steel, it is necessary to cause a reaction therebetween to effect substantial removal of the coating to expose the steel. It has been found that the steel and coating should be heated. Any oxidizing atmosphere may be used, but this heating must be done in the presence of oxygen, such as in air, at temperatures up to 1700° C. (926° C.), as low as 900° F. (482° C.) and preferably 1200 to 1500° F. (649 to 816° C. ) to effect charging.

After heating the agent in the base coating to cause substantial removal in a line pattern, the steel undergoes further or second heating in a reducing atmosphere to cure the material. The atmosphere must be reducing and may include hydrogen and hydrogen mixtures, such as hydrogen-nitrogen, but preferably is substantially straight hydrogen. The curing temperature may range from 1500 to 1800° F. (816 to 982° C.) and preferably ranges from 1550 to 1700° C. (843 to 927° C.).

The charging and curing steps must be performed as two separate steps. However, the charging step may embrace intermediate steps, such as a second or more application or flux-printing agent. The times and temperatures for curing to produce the permanent bodies will vary, however, such times should be less than 15 minutes and preferably less than 7 minutes to be useful in commercial strand-type production operations. For batch-type curing, much longer times, e.g., several hours, are tolerable.

In order to better understand the present invention, the following examples are presented.

EXAMPLE I

Samples of 8-mil final texture annealed high permeability steel (of Steel 2) were treated as Epstein strips using a simulated printing operation. For these runs, full strength (85%) phosphoric acid was used as the printing ink base. The ink was stiffened by adding polyethylene glycol at 10% by weight to form a highly viscous liquid approaching printing ink consistency. Polyethylene glycol is the generic name for a series of water-soluble polymers of varying molecular weight of 200–20,000 with the general formula $H(OCH_2CH_2)_nOH$. As the molecular weight increases the polymer changes from a liquid to a waxy solid. In its various forms, polyethylene glycol is widely used in cosmetics, pharmaceuticals, special printing inks, water soluble lubricants, etc. For purposes herein to thicken the ink, polyethylene glycol Grade 20M (PEG 20M), which has molecular weight of 15,000–20,000, was used.

Printing was simulated very simply by dipping the edge of a razor blade into the ink and then applying the inked edge transversely to the surface of an Epstein strip. Thin lines of ink were applied along the whole length of the strip. The lines were spaced at about a 5 mm interval which is a conventional scribing spacing for domain refining. After printing, the strip was fired (heated) in air at 1300° F. (704° C.) and then the whole process was repeated to provide a second application of phosphorus. The second line of ink was applied directly over the firs to effectively double the amount of ink applied. The samples were then cured in hydrogen at 1650° F. (899° C.) for five hours (as described in the above-mentioned copending U.S. patent application Ser. No. 327,946). Eight strips were treated in this way and magnetic properties before and after firing were determined both as single strips and as an eight strip Epstein pack. The full magnetic properties is shown in Table I. The data show an 8% improvement in core loss by this method of flux printing and phosphorus striping.

TABLE I

| | MAGNETIC PROPERTIES | | | | | | | | |
|---|---|---|---|---|---|---|---|---|---|
| | Original as Scrubbed | | | After Phosphorus Charging | | | After Curing (5 hrs/1650° F. Hydrogen) | | |
| Sample | Permeability | Core Loss (WPP) | | Permeability | Core Loss (WPP)* | | Permeability | Core Loss (WPP)* | |
| No. | @ 10 Oe | 1.5 T | 1.7 T | @ 10 Oe | 1.5 T | 1.7 T | @ 10 Oe | 1.5 T | 1.7 T |
| PH-66 | 1933 | .422 | .619 | 1919 | .436 | .608 | 1897 | .424 | .593 |
| PH-67 | 1916 | .436 | .624 | 1913 | .428 | .605 | 1907 | .428 | .613 |
| PH-68 | 1945 | .460 | .625 | 1937 | .548 | .735 | 1925 | .433 | .624 |
| PH-69 | 1906 | .425 | .624 | 1892 | .448 | .655 | 1879 | .396 | .576 |
| PH-70 | 1924 | .461 | .638 | 1907 | .463 | .639 | 1897 | .388 | .538 |
| PH-71 | 1906 | .409 | .591 | 1901 | .423 | .594 | 1894 | .374 | .526 |
| PH-72 | 1895 | .455 | .659 | 1880 | .489 | .696 | 1868 | .407 | .587 |
| PH-73 | 1890 | .429 | .632 | 1873 | .463 | .669 | 1874 | .377 | .546 |
| Single Strip Average: (n = 8) | 1914 | .442 | .625 | 1903 | .462 (+5%) | .650 (+4%) | 1893 | .403 (−9%) | .575 (−8%) |
| Epstein Pack Props. | 1927 | .434 | .599 | 1914 | .444 (+2%) | .630 (+5%) | 1905 | .401 (−8%) | .558 (−7%) |

*(Numbers in parentheses = % change versus original.)

EXAMPLE II

Samples of final texture annealed high permeability oriented steel of Steel 2 were flux-printed continuously on a Matthews Model 6029 printing press which is capable of printing on 3-inch wide strip material. The press was operated in a flexographic mode (see FIG. 2), i.e., the print roll printed directly on the Epstein strips rather than through the action of a blanket roll. The ink was made by blending 85 parts of 85% phosphoric acid with 15 parts of PEG 20M polyethylene glycol. Viscosity was about 10,000 centipoise.

Printing of 5 mm spaced parallel lines of 0.5–1.0 mm width substantially transverse to the rolling direction of the steel was done at 50 ft/min. line speed. Ink thickness applied to the forsterite layer of steel was about 0.01 mm (0.065 mils). The samples were allowed to dry and then heated in air to 1300° F. (704° C.) to break through or dissolve the forsterite and partially charge the metal stripes with phosphorus. The operation was then repeated, synchronizing the second application to be on top of the first, to further charge the metal stripes with phosphorus so that the applied ink was thicker. The final treatment to cure the samples was done at 5 hours at 1650° F. in hydrogen. Magnetic properties are listed in Table II below. They show a moderate improvement in core loss of about 4% in a batch of strips which had excellent starting properties.

TABLE II

| | MAGNETIC PROPERTIES | | | | | | | | |
|---|---|---|---|---|---|---|---|---|---|
| | Original as Scrubbed | | | After Phosphorus Charging (Continuous Print and Fire-Twice) | | | After Curing (5 hrs/1650° F. Hydrogen) | | |
| Sample | Permeability | Core Loss (WPP) | | Permeability | Core Loss (WPP)* | | Permeability | Core Loss (WPP)* | |
| No. | @ 10 Oe | 1.5 T | 1.7 T | @ 10 Oe | 1.5 T | 1.7 T | @ 10 Oe | 1.5 T | 1.7 T |
| PH-74 | 1927 | .351 | .498 | 1923 | .393 | .552 | 1904 | .359 | .514 |
| PH-75 | 1933 | .391 | .553 | 1931 | .414 | .572 | 1920 | .383 | .505 |
| PH-76 | 1928 | .373 | .547 | 1926 | .388 | .551 | 1913 | .350 | .505 |

TABLE II-continued

| | MAGNETIC PROPERTIES | | | | | | | | |
|---|---|---|---|---|---|---|---|---|---|
| | Original as Scrubbed | | | After Phosphorus Charging (Continuous Print and Fire-Twice) | | | After Curing (5 hrs/1650° F. Hydrogen) | | |
| Sample | Permeability | Core Loss (WPP) | | Permeability | Core Loss (WPP)* | | Permeability | Core Loss (WPP)* | |
| No. | @ 10 Oe | 1.5 T | 1.7 T | @ 10 Oe | 1.5 T | 1.7 T | @ 10 Oe | 1.5 T | 1.7 T |
| PH-77 | 1913 | .385 | .564 | 1911 | .470 | .669 | 1903 | .365 | .537 |
| Single Strip | 1925 | .375 | .541 | 1923 | .416 | .586 | 1910 | .364 | .515 |
| Average | | | | | (+11%) | (+8%) | | (−3%) | (−5%) |

*(Numbers in parentheses = % change versus original.)

EXAMPLE III

As in Example II, samples of high permeability oriented steel of Steel 2 were flux-printed continuously on a Matthews Model 6029 printing press. The press was operated in a flexographic mode (see FIG. 2), i.e., the print roll printed directly on the Epstein strips rather than through the action of a blanket roll. The ink was made by blending 85 parts of 85% phosphoric acid with 15 parts of PEG 20M polyethylene glycol. Viscosity was about 10,000 centipoise.

Printing of 5 mm spaced parallel lines of 0.5-1.0 mm width substantially transverse to the rolling direction of the steel was done at 50 ft/min. line speed. The printer was adjusted to yield about twice the thickness of ink to the forsterite layer compared with Example II (i.e., 0.02 mm (0.13 mils)). The samples were fired immediately in air at 1300° F. (704° C.) without waiting to dry as was done in Example II. The operation (print and fire) was then repeated three times synchronizing the print lines on top of those of the initial operation. Firing of the ink before completely dry caused some spread in the flux craters created, i.e., they were not in as straight a line as the originally-printed ink. It is known in the technology of scribing of electrical steels that the line-breaks in the domain structure need not be straight to effect domain refinement.

Figure 3A:
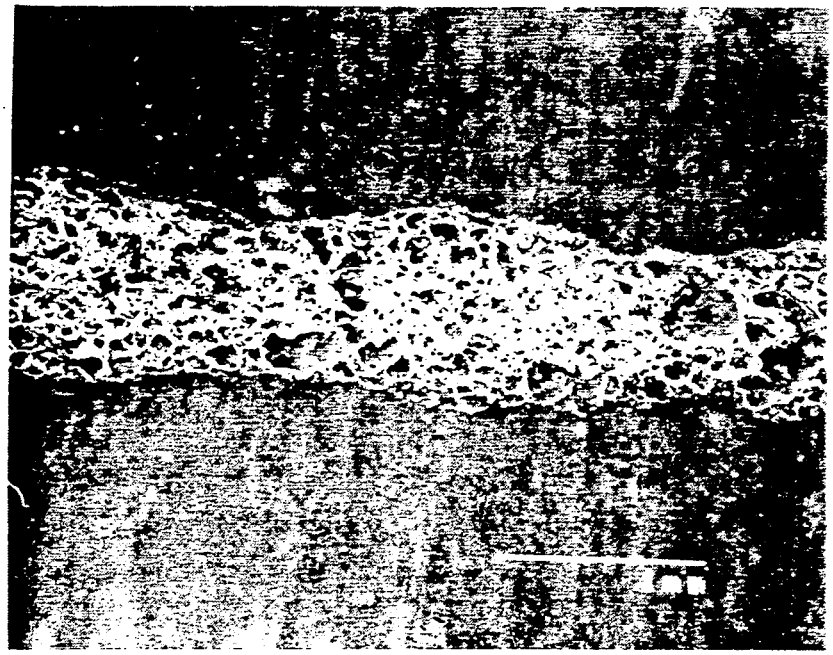
FIGS. 3*a* and 3*b* are photomicrographs of a surface treated in accordance with the present invention.
Figure 3B:
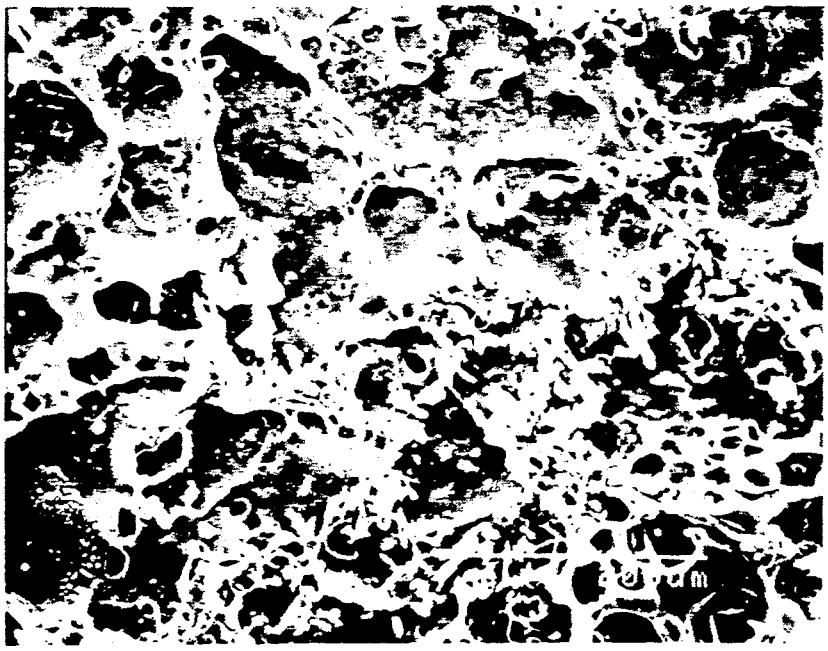

The phosphorus-charged strips were bulk analyzed for phosphorus and indicated total content of 0.3% compared with 0.025% in the initial starting material. The additional phosphorus was no doubt concentrated in the charged lines. FIGS. 3A and 3B are photomicrographs of the surface of the phosphorus-charged line.

In this example, samples were cured quickly using a furnace with a continuously-moving mesh belt on which samples could be laid. The atmosphere was dry (<−20°F. Dew Point) hydrogen and samples were given a 4-minute treatment at 1550° F. (843° C.), 1625° F. (885° C.), or 1700° F. (927° C.) and magnetic properties determined. The heat treatment was then repeated representing cumulatively an 8-minute treatment. These ties were selected to simulate ranges suitable for a continuous process line.

Figure 4A:
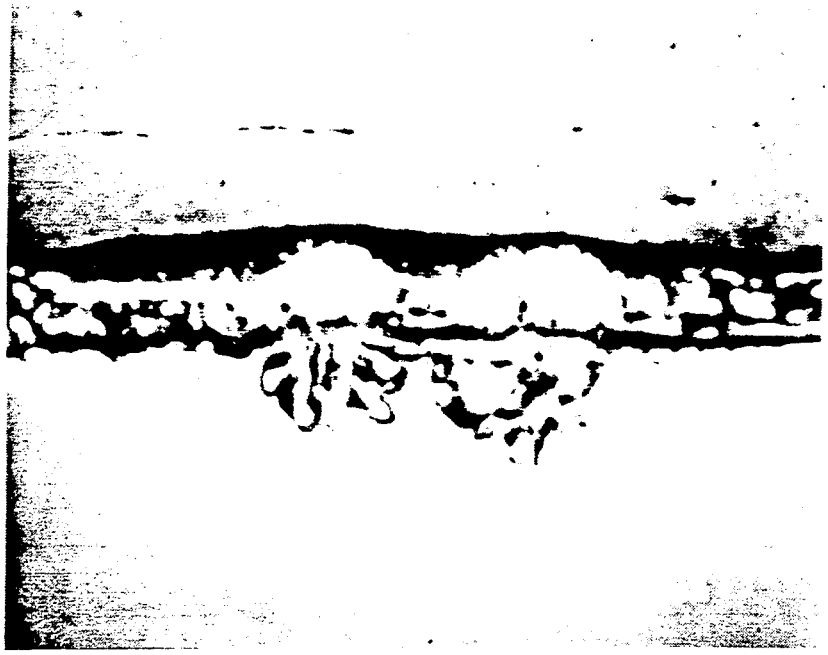
FIGS. 4A and 4B are photomicrographs of the surface in cross section of a test specimen as continuously annealed in hydrogen showing phosphide particles.
Figure 4B:
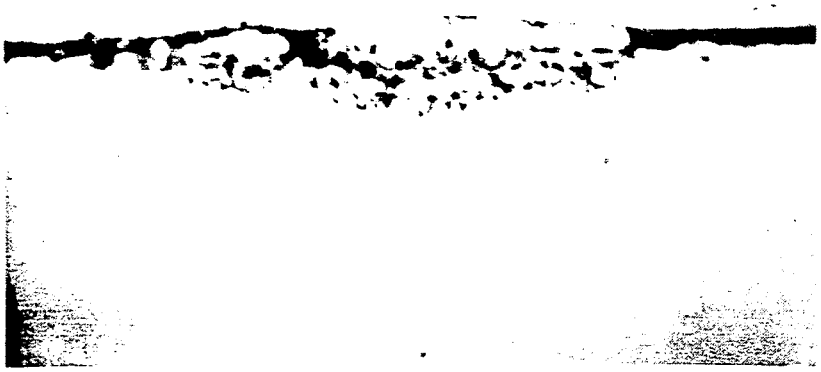

Results are shown in Table III and show improved properties with all the treatments. FIGS. 4A and 4B show an example of phosphide particles in the steel surface layers, generated during the curing operation and responsible for domain refinement. The data show 4 minutes at 1625° F. (885° C.) or 1700° F. (927° C.) to yield good magnetic response while minimizing the duration of the curing anneal.

TABLE III

| | MAGNETIC PROPERTIES | | | | | | | | |
|---|---|---|---|---|---|---|---|---|---|
| | Original Properties | | | Cured in Hydrogen for 4 Mins. at Indicated Temp. | | | Cured in Hydrogen for 8 Mins. at Indicated Temp. | | |
| Epstein | Permeability | Core Loss (WPP) | | Permeability | Core Loss (WPP)* | | Permeability | Core Loss (WPP)* | |
| Pack No. | @ 10 Oe | 1.5 T | 1.7 T | @ 10 Oe | 1.5 T | 1.7 T | @ 10 Oe | 1.5 T | 1.7 T |
| | | | | CURED AT 1550° F. | | | | | |
| 1 | 1926 | .514 | .690 | 1898 | .484 | .656 | 1900 | .432 | .599 |
| | | | | | (−6%) | (−5%) | | (−16%) | (−13%) |
| | | | | CURED AT 1625° F. | | | | | |
| 2 | 1911 | .537 | .741 | 1886 | .432 | .606 | 1880 | .428 | .647 |
| | | | | | (−20%) | (−18%) | | (−28%) | (−17%) |
| | | | | CURED AT 1700° F. | | | | | |
| 3 | 1926 | .437 | .607 | 1896 | .409 | .546 | 1897 | .398 | .550 |
| | | | | | (−6%) | (−10%) | | (−9%) | (−9%) |

*(Numbers in parentheses = % change versus original.)

EXAMPLE IV

In this Example, samples of high permeability oriented steel of Steel 2 were flux-printed and air-fired in identical manner to that described for Example 3. The curing cycle was also of similar brief duration using the mesh belt furnace. The difference from Example III was that 80:20 nitrogen-hydrogen (<−20° F. Dew Point) was substituted for pure hydrogen in the curing cycle. Results are displayed in Table IV. Those samples showed an improvement over original, the exception being the 8-minute treatment at 1700° F. which showed a deterioration in core loss. Generally the response was not as good in the mixed atmosphere as in hydrogen alone.

TABLE IV

| Epstein Pack No. | Original Properties: Permeability @ 10 Oe | Original Properties: Core Loss (WPP) 1.5 T | Original Properties: Core Loss (WPP) 1.7 T | Cured in 80:20 Nitrogen: Hydrogen for 4 Mins. at Indicated Temp.: Permeability @ 10 Oe | Cured in 80:20 Nitrogen: Hydrogen for 4 Mins. at Indicated Temp.: Core Loss (WPP)* 1.5 T | Cured in 80:20 Nitrogen: Hydrogen for 4 Mins. at Indicated Temp.: Core Loss (WPP)* 1.7 T | Cured in 80:20 Nitrogen: Hydrogen for 8 Mins. at Indicated Temp.: Permeability @ 10 Oe | Cured in 80:20 Nitrogen: Hydrogen for 8 Mins. at Indicated Temp.: Core Loss (WPP)* 1.5 T | Cured in 80:20 Nitrogen: Hydrogen for 8 Mins. at Indicated Temp.: Core Loss (WPP)* 1.7 T |
|---|---|---|---|---|---|---|---|---|---|
| | | | | CURED AT 1625° F. | | | | | |
| 1 | 1902 | .451 | .646 | 1888 | .448 (−1%) | .639 (−1%) | 1892 | .437 (−3%) | .627 (−3%) |
| | | | | CURED AT 1700° F. | | | | | |
| 2 | 1900 | .446 | .644 | 1890 | .428 (−4%) | .618 (−4%) | 1896 | .425 (+1%) | .665 (+3%) |

*(Numbers in parentheses = % change versus original.)

EXAMPLE V

In this Example, 7-mil gauge strip samples of oriented steel of conventional permeability (Steel 1)were evaluated with respect to the flux-print-phosphorus-charge/-fast-hydrogen-cure sequence. Procedure was then same a in Example III but evaluating only the one temperature-time combination for curing of 1625° F. for 4 minutes. Results are given in Table V and display significantly improved core losses. Note that this steel had a lower permeability than in the previous Examples which would make it less susceptible to domain refinement. However, it was also of lighter gauge (7 mil) which would make it more susceptible to domain refinement, independent of permeability, than the high permeability 8-mil material of Examples I through IV.

TABLE V

| Original Properties: Permeability @ 10 Oe | Original Properties: Core Loss (WPP) 1.5 T | Original Properties: Core Loss (WPP) 1.7 T | Cured in Hydrogen for 4 mins. at 1625° F.: Permeability @ 10 Oe | Cured in Hydrogen for 4 mins. at 1625° F.: Core Loss (WPP)* 1.5 T | Cured in Hydrogen for 4 mins. at 1625° F.: Core Loss (WPP)* 1.7 T |
|---|---|---|---|---|---|
| 1869 | .414 | .628 | 1850 | .393 (−5%) | .604 (−4%) |

*(Numbers in parentheses = % change versus original.)

It is part of the present invention to provide a single method of both breaking through or dissolving the forsterite and charging sufficient extra phosphorus as phosphates into the exposed metal series to cause domain refinement on curing. The fluxing through the nominally 5-micron thick forsterite is relatively straight-forward and forms part of the basis of the previous copending application Ser. No. 327,946, filed Mar. 23, 1989, mentioned above. In this latter application, completion of domain refining was accomplished by supplying phosphorus vapor from an external source, namely through hydrogen reduction to breakdown a phosphate coating covering the complete strip surface. In the present invention, the excess phosphorus needed is delivered as part of the fluxing operation (i.e., the metal striping). The method of providing sufficient phosphorus to do the dual job (breaking through the for sterite and charging the necessary excess phosphorus for domain refining) may be accomplished in several ways in accordance with the present invention. These include using more concentrated (i.e., greater phosphorus content) ink, adding more per treatment, or using multiple treatments. These options will now be discussed.

In regard to phosphorus enrichment of the ink, it is noted that the ink used in the Examples described contained only about 24% P. Phosphoric acid itself contains only 32% P. Since in this approach phosphorus acid is to be used as the main fluxing agent, it should be kept as a major component of the ink and the ink made to contain phosphoric acid in an amount at least sufficient to break through the forsterite layer to expose the metal stripes. Further enrichment may be accomplished by substituting a phosphorus-containing solid, at least to replace the 15% polyethylene glycol which is added solely as a thickening agent to obtain the correct ink viscosity.

From the standpoint of adding more ink per treatment, the flexographic printing technology can offer rapid printing at thicknesses an order of magnitude thicker than the well known offset printing. The difference between these two methods has already been described. It should be noted in several of the above Examples that a machine designed of offset printing can be used in a flexographic mode, i.e., the print roll collected its ink from an ink roll and laid it directly on the strip. This simulation was deficient in that the honeycomb-surfaced ink roll (often referred to in flexographic printing as the anilox roll) was not present; instead the smooth ink roll characteristic of offset printing was in place. It is the absorbent anilus roll, coupled with a highly flexible print roll, that allows much tolerance and versatility in flexographic printing, including thick printing of the type desirable for this invention.

The multiple print and fire operations such as were used in the Examples may or may not be done in a single operation with true flexographic printing. While normally a multiple repeated step operation would be expected to be more complex and costly than a single operation, dividing the flux ink applications into several increments may have some advantages. The relatively smaller amount of ink needed to be deposited at each station means that conventional three-roller offset printers (see FIG. 1) could be used. These printers are basically simple, reliable and inexpensive. Although repeated firing of the flux-printed strip could be cumbersome, the employment of transverse flux heating furnaces such as has been described in U.S. Pat. No. 4,751,360 may be beneficial. These furnaces, most importantly, have the capability of extremely fast heating, ideal for the flux firing of the present invention. The printing device, likewise, need not be large, e.g., less than several feet long.

Figure 5:
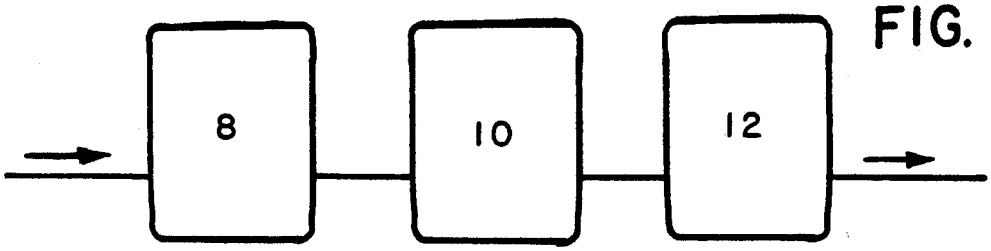
FIG. 5 is a schematic arrangement of equipment modules in accordance with the present invention.

It is anticipated that a flux-print and fire module would take relatively small space. Several modules could be spaced in series in line. Synchronization of the modules could allow consecutive printing to be precisely controlled in phase similar to the technology available in the paper printing industry. FIG. 5 is a schematic arrangement of equipment modules with module 8 representing the printing module for applying the flux agent. Module 10 represents the module for heating in the oxidizing atmosphere and module 12 represents the module for the second heating in the reducing atmosphere. It should be understood that one or more modules 8 and 10 may be arranged in line to permit multiple sequencing of applying the agent and first heating.

Control of the amount of phosphorus added would be relatively easy since there would be several control points available (i.e., one at each module). The ability to precisely control the amount of phosphorus added would then allow optimization to produce the desired domain refinement with minimal surface effects. Undesirable ink spread could be minimized with the use of several small ink applications and the fast heat for firing. Such a multimode arrangement would permit, if desired, use of different ink compositions and different firing temperatures at each module. For example, it has been found that a trace of potassium fluoroborate in the phosphorus-bearing flux will make the flux extremely aggressive to forsterite. Accordingly, in some applications ink with this additive in the first module could be used to open up a thin line of deep craters, with use of 1400° F. (760° C.) firing temperature, for example. The ink in the second, and if desired additional modules, could be less aggressive, with phosphoric acid only as the active agent, and serving to further widen the existing craters and, importantly, to load or charge them with more phosphorus. A lower temperature, for example, 1000° F. (538° C.) could be used.

Although a preferred and alternative embodiments have been described, it will be apparent to one skilled in the art that changes can be made therein without departing from the scope of the invention.

What is claimed is:

1. A method of refining the magnetic domain wall spacing of a grain-oriented silicon steel sheet having an insulation base coating thereon, the method comprising:

applying a flux-printing agent to the base coating in a predetermined line pattern, a major component of said agent selected from the group of phosphorus and phosphorus-bearing compounds, said agent having sufficient phosphorus to facilitate domain refinement;

then first heating the agent on the base coated steel in an oxidizing atmosphere to react and cause substantial removal of the base coating and substantially expose the steel in the line pattern; and thereafter, second heating the sheet in a reducing atmosphere at a time and temperature to produce a permanent body containing a phosphorus-bearing compound in the pattern of exposed steel to effect heat resistant domain refinement and reduced core loss.

2. The method of claim 1 wherein the step of first heating includes temperatures up to 1700° F.

3. The method of claim 2 wherein the step of first heating includes temperatures of 1200 to 1500° F.

4. The method of claim 1 wherein the step of first heating includes temperatures as low as 900° F to react and cause substantial removal of the base coating in the line pattern.

5. The method of claim 1 wherein the step of applying the agent is repeated two or more times.

6. The method of claim 5 includes an intermediate step between the first and second heating steps, the intermediate step comprising applying an additional amount of flux-printing agent one or more times to increase a phosphorus charge to the steel and to remove base coating.

7. The method of claim 5 where the steps of applying the agent and first treating in an oxidizing atmosphere are repeated before thereafter second heating in a reducing atmosphere.

8. The method of claim 5 wherein the sheet is subjected to two or more sequential applications of an agent followed by heating in an oxidizing atmosphere to substantially remove the base coating and charge the exposed steel.

9. The method of claim 5 wherein in said first application of the agent, said agent includes potassium fluoroborate.

10. The method of claim 5 wherein the total amount of said agent to effect said results is proportioned between two or more of said applications.

11. The method of claim 5 wherein said insulation coating takes the form of forsterite and wherein before the last application of the flux-printing agent, the agent includes an element extremely aggressive to said forsterite coating.

12. The method of claim 5 wherein said coating takes the form of forsterite and wherein before the last application, the flux-printing agent includes a relatively small amount of potassium fluoroborate.

13. The method of claim 5 wherein separate modules are used to provide each step of applying the flux-printing agent and each heating step and wherein said applying and heating steps are performed in series on a moving sheet advanced from one module to an adjacent module arranged in the path of movement of the sheet.

14. The method of claim 1 wherein the second heating includes temperatures of 1500 to 1800° F.

15. The method of claim 14 wherein the heating includes temperatures of 1550 to 1700° F.

16. The method of claim 1 wherein the second heating for curing is performed in less than 15 minutes.

17. A method of refining the magnetic domain wall spacing of a final texture annealed grain-oriented silicon steel sheet having an insulation coating thereon, the method comprising:

applying a flux-printing agent to the base coating in parallel lines substantially transverse to the direction of rolling the steel, a major component of said agent selected from the group of phosphorus and phosphorus-bearing compounds, said agent having sufficient phosphorus to charge the steel after heating;

heating the agent on the base coated steel from 900° F. up to 1700° F. in an oxidizing atmosphere to react and cause substantial removal of the base coating to substantially expose the steel along said lines and to charge phosphorus to the exposed steel; and thereafter second heating the sheet in a reducing atmosphere including hydrogen from 1550° F. up to 1700° F. to produce a permanent body containing a phosphide compound in the lines of exposed steel to effect heat resistant domain refinement and reduced core loss.

* * * * *